US006279268B1

(12) United States Patent
Beaudoin et al.

(10) Patent No.: US 6,279,268 B1
(45) Date of Patent: Aug. 28, 2001

(54) CABLE FAILURE DEVICE FOR GARAGE DOORS AND THE LIKE

(75) Inventors: Michel Beaudoin, Drummondville; Pierre-Louis Foucault, St-Lambert; Stefano Bologna, Montreal; Patrice Farella, St-Jean-sur-le-Richelieu, all of (CA)

(73) Assignee: Canimex, Inc., Drummondville (CA)

( * ) Notice: Subject to any disclaimer, the term of this patent is extended or adjusted under 35 U.S.C. 154(b) by 0 days.

(21) Appl. No.: 09/527,794

(22) Filed: Mar. 17, 2000

(30) Foreign Application Priority Data

Mar. 18, 1999 (CA) ..... 2263666

(51) Int. Cl.[7] ..... E05D 17/00
(52) U.S. Cl. ..... 49/322; 160/193
(58) Field of Search ..... 160/193, 192, 160/188, 189, 201, 207; 49/197, 199, 200, 322

(56) References Cited

U.S. PATENT DOCUMENTS

| | | | | |
|---|---|---|---|---|
| 2,185,828 | * | 1/1940 | Blodgett | 49/322 |
| 2,651,817 | * | 9/1953 | Moler | 49/322 X |
| 2,869,183 | * | 1/1959 | Smith | 49/322 |
| 3,188,698 | * | 6/1965 | Zoll et al. | 49/322 |
| 3,958,367 | | 5/1976 | Fairman . | |
| 4,019,442 | | 4/1977 | Lee et al. . | |
| 4,385,471 | * | 5/1983 | Gabry et al. | 49/322 |
| 4,520,591 | | 6/1985 | Calvagno . | |
| 4,604,828 | * | 8/1986 | Baarse | 49/322 |
| 4,697,676 | | 10/1987 | Haake . | |
| 4,750,294 | | 6/1988 | Lafontaine . | |
| 4,813,305 | | 3/1989 | Dilich . | |
| 4,956,938 | | 9/1990 | DeMent . | |
| 5,090,522 | | 2/1992 | Korff . | |
| 5,239,777 | | 8/1993 | Husselton . | |
| 5,291,686 | | 3/1994 | Sears et al. . | |
| 5,353,859 | | 10/1994 | Oltahfer et al. . | |
| 5,419,010 | | 5/1995 | Mullet . | |
| 5,490,662 | | 2/1996 | Wright . | |
| 5,581,939 | | 12/1996 | Regan et al. . | |
| 5,615,723 | | 4/1997 | Carper . | |
| 5,684,372 | | 11/1997 | Fitzgibbon et al. . | |
| 5,743,046 | | 4/1998 | Siegler et al. . | |

* cited by examiner

*Primary Examiner*—David M. Purol
(74) *Attorney, Agent, or Firm*—Merchant & Gould P.C.

(57) ABSTRACT

A cable failure device for a mobilizing a garage door in the event of a failure of one of the cables or one of the elements holding the cables is described. The cable failure device of the invention includes a support structure mounted on the cable operated door and includes a connection point onto which a tensioned cable is connected. A braking assembly is mounted onto the support structure and includes a casing mounted onto the support structure and a brake operable between a rest position and an operable position. The brake is movably mounted to the support structure and is located adjacent the outside of a fixed frame such as guide rails and is adapted to co-operate with a roller on the garage door so that a portion of the guide rail lies between the roller and the brake. A tension detector co-operating with the tension cable is provided for detecting a tension in the tension cable and an actuator is operatively connected to the tension detector and to the brake. When the brake is in the rest position, the rollers guide the door along the rail and when the brake is triggered into the operable position by a loss of tension in the cable detected by the tension detector, it causes the actuator to actuate the brake so that it engages the outside of these rails, thereby urging the brake and one of the rollers towards each other. This combined action brakes the movement of the cable operated door and thus impedes its free falling to the ground, thereby preventing damages and injuries.

10 Claims, 11 Drawing Sheets

CABLE FAILURE DEVICE FOR GARAGE DOORS AND THE LIKE

FIELD OF THE INVENTION

The present invention relates to a safety device for use with a cable operated door, such as garage doors and the like. It is used to hold the garage door in position in case of a rupture of one of the cables or in case of a failure of one of the elements that hold the cables. The device ensures that the garage door does not fall all the way down and does not cause damages or even injuries.

BACKGROUND OF THE INVENTION

Cable operated doors such as garage doors are well known in the art. A garage door is usually connected to an overhead counterbalancing mechanism that provides a counterbalancing force in order to decrease the force required to open the door and also facilitate its closing. The garage door is connected to the counterbalancing mechanism by means of two cables, one at the right and one at the left. The cables are usually made of steel. The lower free end of each cable is attached at the bottom of the door.

It is also known in the art that occasionally, for one reason or the other, one of the cable brakes or one of the elements holding such cables undergoes failure, leading to the garage door falling all the way down, causing damages or even personal injuries. There have been many attempts to come up with safety devices used in the event of a failure of a cable or of an element holding the same.

Known in the art is U.S. Pat. No. 5,291,686 to SEARS et al. This patent describes an overhead door safety apparatus for a cable controlled door whose movement is guided by a stationary guide track. The apparatus includes a brake assembly which is attached to the door and which is responsive to a decrease in a predetermined cable tension. When the decrease in the predetermined cable tension takes place, the overhead door safety apparatus is actuated causing the brake assembly to apply a braking action on movement of the overhead door. More specifically, in the brake assembly, a cable-tension-responsive track follower guides motion of the door by following the track. The cable-tension-responsive track follower has a first and a second operating state. The first operating state permits smooth movement of the cable-tension-responsive track follower along the track as the door moves when a control cable maintains a predetermined amount of cable tension. The second operating state of the cable-tension-responsive track follower is automatically actuated and automatically provides a braking action against the track to halt movement of the overhead door when a control cable has less than the predetermined amount of a cable tension, such as when a counterbalance spring breaks or when the cable itself breaks.

Also known in the art is U.S. Pat. No. 4,520,591 to CALVAGNO. This patent describes a safety lock assembly for use with a garage door to prevent the latter from falling uncontrollably in the event the counterweight system supporting the garage door fails. The invention has a pivoted arm biased into a position blocking door movement. The counterweight system is attached to the pivoted arm to overcome the bias. In the event of a failure in the weight supporting members, the built-in bias will move the arm into its position where further significant movement of the door is prevented.

Also known in the art is U.S. Pat. No. 3,958,367 to FAIRMAN. This patent describes a safety device for use in combination with elongated coil springs substantially balancing the door weight for ease of opening and adapted to urge the door toward an open position after partial opening movement. The safety device comes into play in the event that a coil spring breaks. The safety device includes an elongated flexible member extending longitudinally substantially axially through the elongated spring and substituting for the spring in the event that the spring breaks. The extent to which the door moves after breakage of a spring depends upon the extent of stretching that the elongated flexible safety member undergoes after the spring breaks.

Also known in the art are the following U.S. patents which describe different safety methods and safety apparatuses for garage doors and the like: U.S. Pat. Nos. 4,019,442; 4,697,676; 4,750,294; 4,813,305; 4,956,938; 5,090,522; 5,239,777; 5,353,859; 5,419,010; 5,490,662; 5,581,939; 5,615,723; 5,684,372; and 5,743,046.

None of the above-mentioned patents provides a simple, compact, reliable and cost effective safety device for stopping downward movement of a cable operated door, such as garage doors and the like, in the event of a failure of one of the cables holding such cable operated door or in the event of a failure of one of the elements holding the cables.

Therefore, there is a need for a more compact, more reliable, easier to use, easier to maintain, safer, and more cost effective safety device for stopping downward movement of a cable operated door, such as garage doors and the like, in the event of a failure of one of the cables holding such cable operated door or in the event of a failure of one of the elements holding the cables, than what is available in the prior art.

SUMMARY OF THE INVENTION

The object of the present invention is to provide a cable failure device which satisfies each of the above-mentioned needs.

More particularly, the object of the present invention is to provide a cable failure device for immobilizing a cable operated door, such as garage doors and the like, in the event of a failure of one of the cables operating such cable operated door or in the event of a failure of one of the elements holding the cables, in order to impede free falling of the cable operated door thereby preventing damages and injuries.

In accordance with the present invention, the above object is achieved with a cable failure device for a cable operated door whose movement is guided along a fixed frame through guiding means, the fixed frame having an inside and an outside, said guiding means traveling along the inside of said fixed frame, said cable failure device cooperating with a tensioned cable operating the cable operated door, said cable failure device comprising:

- a support structure mounted onto said cable operated door, said support structure comprising a connection point onto which the tensioned cable is connected; and
- a braking assembly mounted onto the support structure, said braking assembly comprising:
  - a casing mounted onto the support structure,
  - brake means operable between a rest position and an operable position and movably mounted to the support structure, said brake means being located adjacent the outside of said fixed frame, and adapted to cooperate with one of said guiding means, so that a portion of said fixed frame lies between said one of said guiding means and said brake means,
  - tension-detecting means cooperating with the tensioned cable for detecting a tension in said tensioned cable, and actuating means operatively connected to the tension-detecting means and to the brake means, wherein when the brake means is in the rest position, the guiding means guide the cable operated door along the fixed frame, and when the brake means is triggered into the operable position by a loss of tension in the tensioned cable detected by the tension-detecting means, said loss of tension causes the actuating means to actuate the brake means so that the brake means engages the outside of the fixed frame, thereby urging said brake means and said one of said guide means towards each other, thereby braking the movement of the cable operated door with respect to the fixed frame, the actuating means are operatively connected to an axle of the casing, and the brake means is pivotally mounted to the support structure about said axle and eccentrically mounted thereon, the brake means being adapted to engage the fixed frame, so that when the brake means is in the rest position, the guiding means guide the cable operated door along the fixed frame, and when the brake means is triggered into the operable position by a loss of tension in the tensioned cable detected by the tension-detecting means, said loss of tension causes the actuating means to actuate the axle thereby actuating the brake means so that the brake means engages the fixed frame, thereby urging said brake means and said one of said guide means towards each other, thereby braking the movement of the cable operated door with respect to the fixed frame; and the tension-detecting means comprises a lever pivotally connected to the casing, said lever having a first extremity held in position by the tensioned cable and a second extremity resting against a trigger plate rigidly mounted onto the axle, and the actuating means comprises an energy-storing spring having a first end fixedly mounted onto said axle and a second end securely mounted onto the support structure, so that when the brake means is in the rest position the trigger plate maintains the energy-storing spring in a compressed position thereby storing energy in said energy-storing spring, and wherein said loss of tension in the tensioned cable releases the lever which consequently releases the trigger plate in turn allowing the axle to rotate due to the energy released by the energy-storing spring, thereby triggering the brake means into the operable position so that the brake means frictionally engages the outside of the fixed frame, thereby braking the movement of the cable operated door with respect to the fixed frame.

The objects, advantages and other features of the present invention will become more apparent upon reading of the following non-restrictive description of a preferred embodiment thereof, given for the purpose of exemplification only with reference to the accompanying drawings.

DETAILED DESCRIPTION OF A PREFERRED EMBODIMENT OF THE INVENTION

Figure 1:
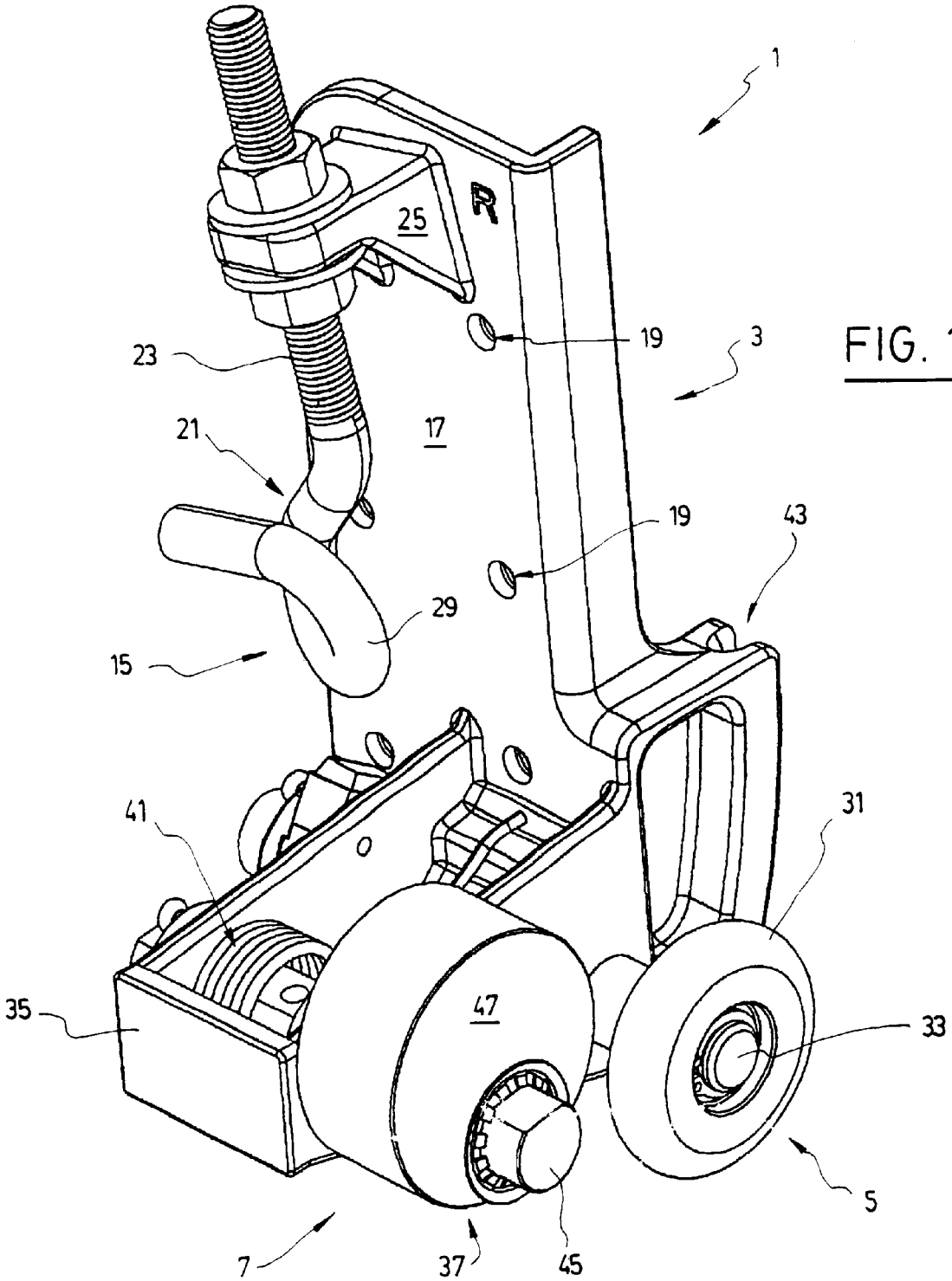
FIG. 1 is a perspective view of the cable failure device according to a preferred embodiment of the invention.

In the following description, the same numerical references refer to similar elements. The embodiments shown in the figures are preferred. In the context of the present description, the expression "garage door" includes all types of cable operated doors. Although the present invention was primarily designed for a garage door, it may be used with other kinds of doors, such as slidable truck doors, or with any other items suspended by a cable, as apparent to a person skilled in the art. For this reason, the expression "garage door" should not be taken as to limit the scope of the present invention and includes all other kinds of doors or items with which the present invention may be useful. Hence, in the context of the present invention, the expressions "garage door" and "cable operated door" will be used interchangeably.

The cable failure device 1 according to the preferred embodiment of the invention as it is illustrated with accompanying drawings is a cable failure device 1 comprising a support structure 3 and a brake assembly 7. Preferably, the cable failure device 1 also comprises a guiding device 5 which is preferably mounted onto the support structure 3. The cable failure device 1, hereinafter called "CFD" 1, is a safety device used for a cable operated door 9, such as garage doors and the like, whose movement is guided along a fixed frame 11 with guiding devices 5, such as rollers. The cable operated door 9 is held and operated by tensioned cables 13. The CFD 1 cooperates with the tensioned cables 13 operating such a cable operated door 9 and is used for immobilizing the cable operated door 9 in the event of a failure of one of these tensioned cables 13 or in the event of a failure of one of the elements holding the tensioned cables 13. In general terms, the invention works on the principle of pinching (immobilizing) the fixed frame 11 between a brake device 37 and one of the rollers 31 (see FIG. 10).

Figure 2:
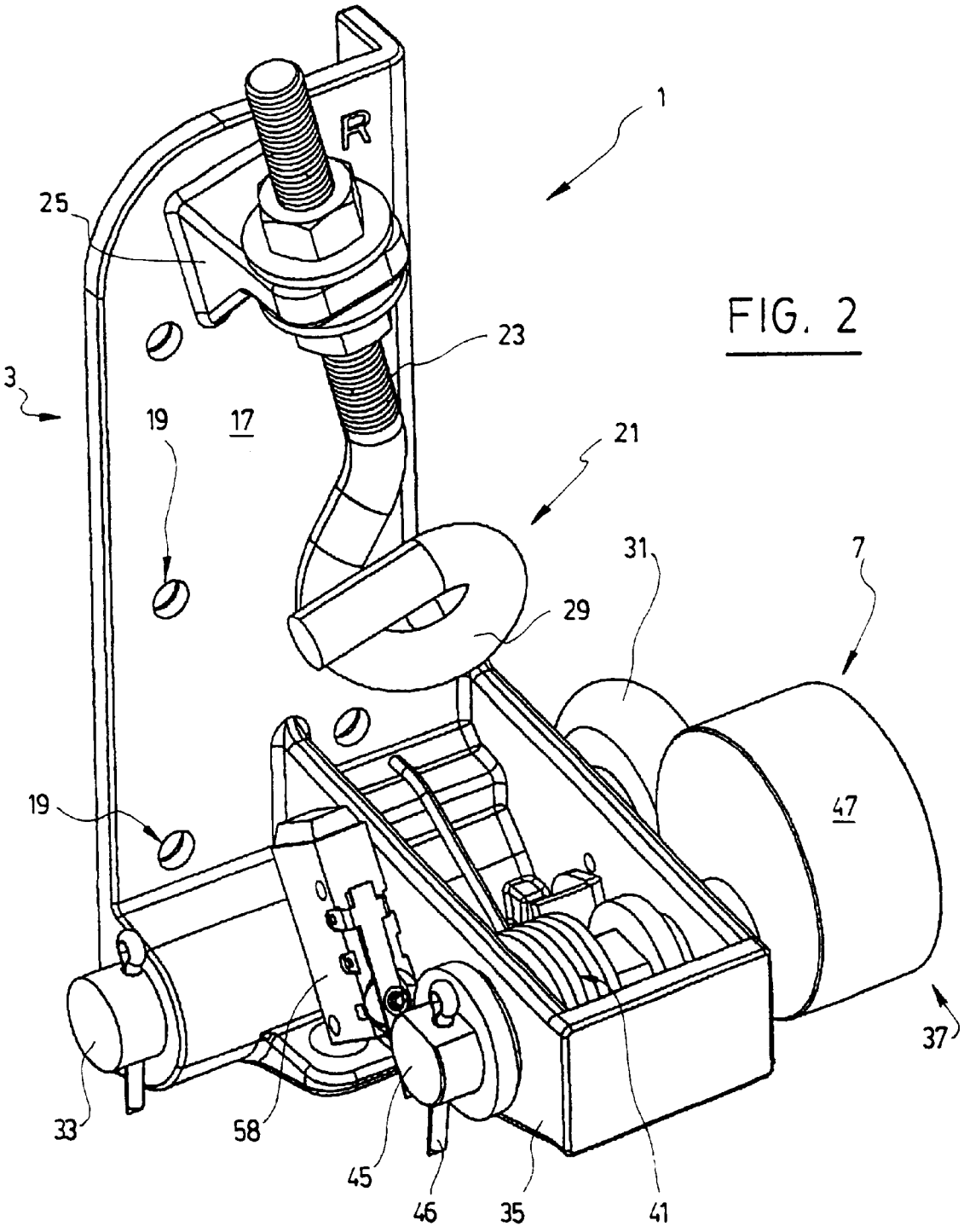
FIG. 2 is another perspective view of the cable failure device shown in FIG. 1.
Figure 3:
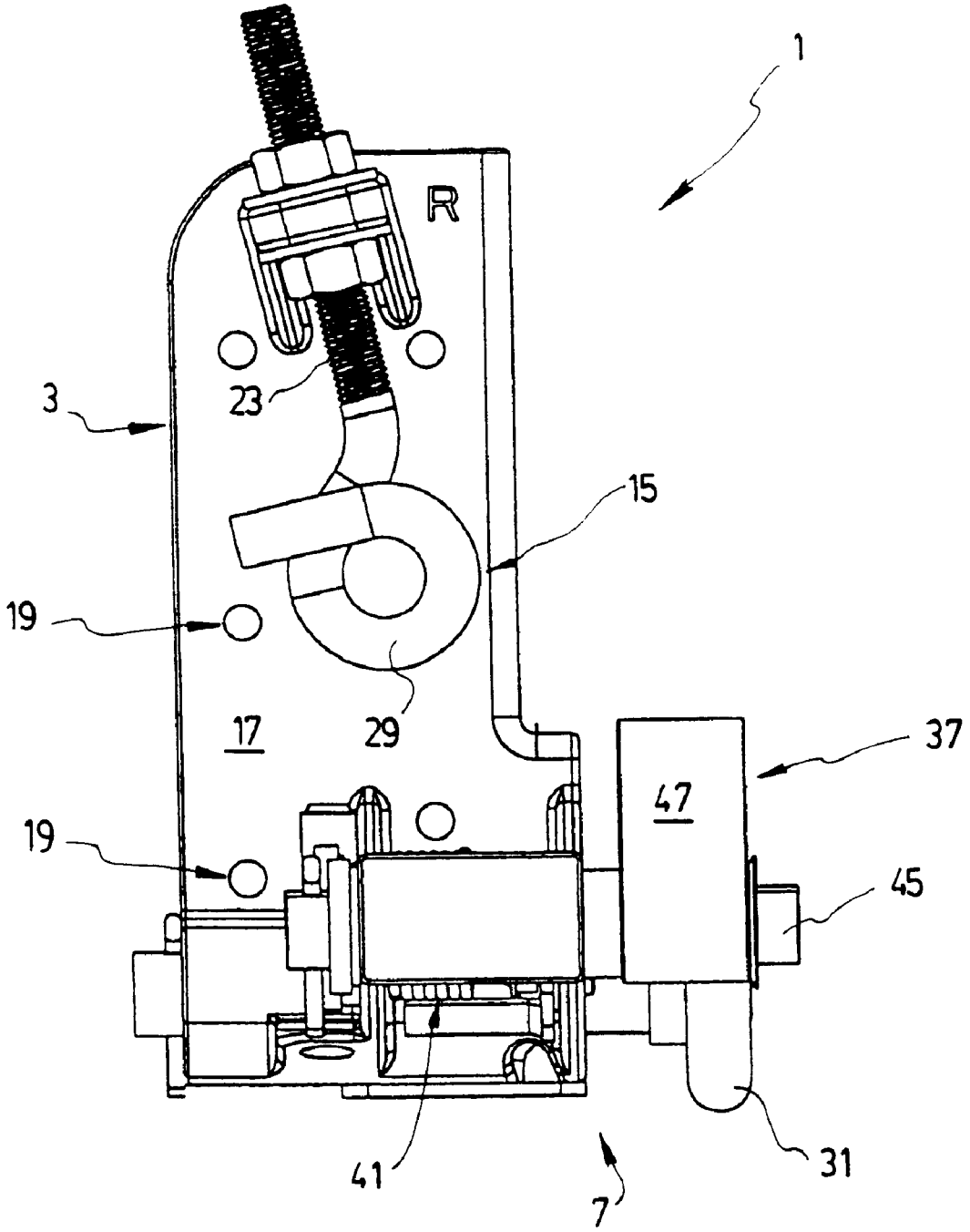
FIG. 3 is a front plan view of the cable failure device shown in FIG. 1.
Figure 4:
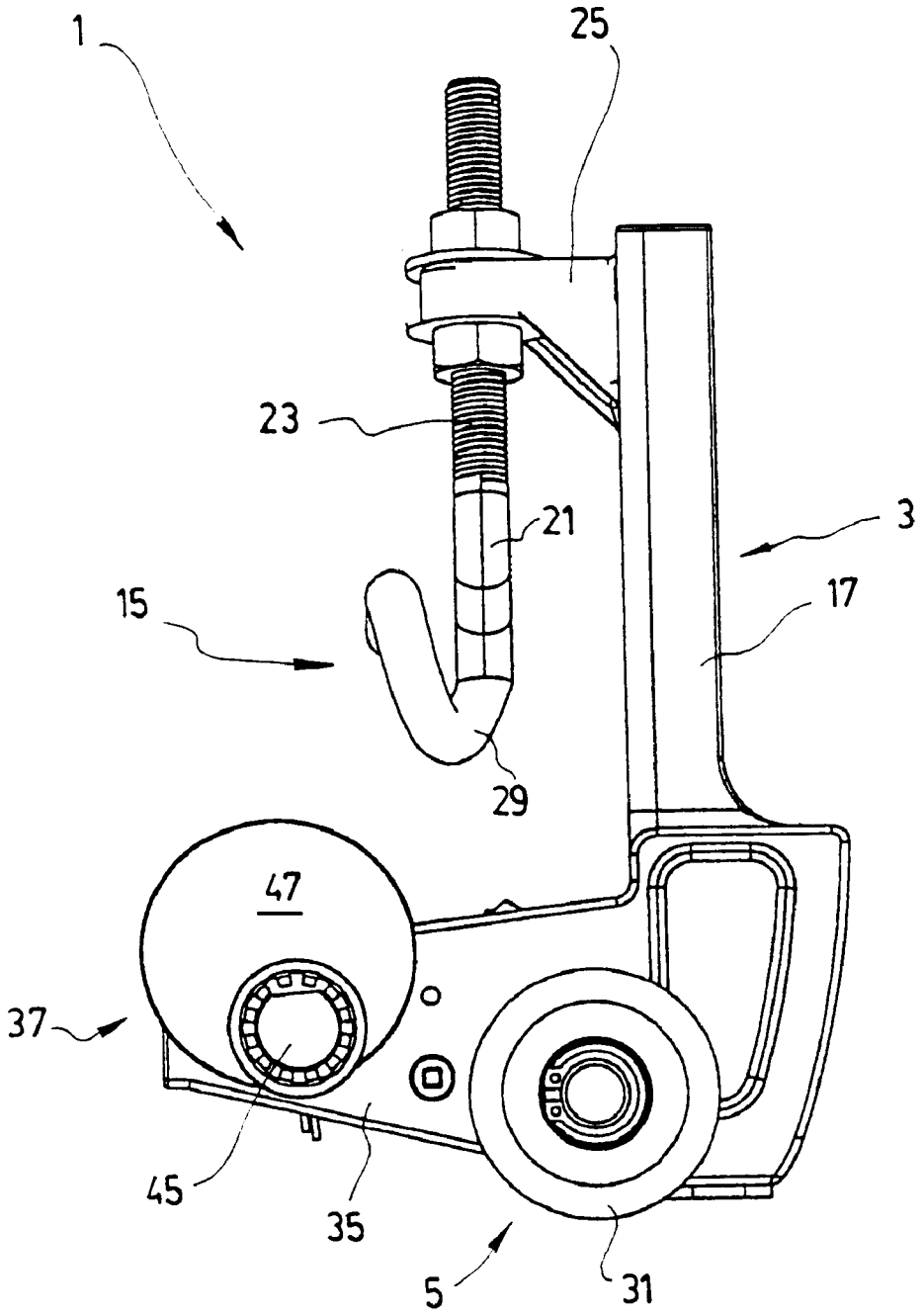
FIG. 4 is a side plan view of the cable failure device shown in FIG. 1, said cable failure device being shown in a rest position.

Referring now to FIGS. 1 and 2, one can see that the support structure 3 is mounted onto the cable operated door 9 and comprises a connection point 15 onto which a tensioned cable 13 is connected. The device shown in FIG. 1 is a "right" CFD 1 to be located at the bottom of the garage door, more specifically at the right-hand side thereof when viewed from the inside of the garage. A "left" CFD 1, that is, a left-hand side version of the CFD 1 shown, would simply be a mirror image of what is shown in FIG. 1. Each CFD 1, whether it be "right" or "left", can preferably hold half the load of the garage door and is directly attached to its corresponding tensioned cable 13. The support structure 3 of the CFD 1 preferably consists of a bracket 17 provided with holes 19 in which fasteners, such as screws and bolts, can be inserted for ridigly mounting the support structure 3 onto the cable operated door 9. Preferably, the connection point 15 consists of a hook 21. The hook 21 preferably has a first part 23 removably mounted onto a flange 25 of the support structure 3. Preferably, this first part 23 is threaded and is removably screwed into a corresponding threaded cavity 27 of the flange 25 and fastened thereon by means of fasteners, such as nuts and washers. Preferably also, the hook 21 also has a curved second part 29 onto which is attached a free end of the tensioned cable 13, as better shown in FIG. 8. The hook 21 is connected to the flange 25, itself connected to the bracket 17. It is worth noting here that the bracket 17, flange 25, and hook 21 can be separate elements or can be made integral to each other. That is, one or several of these elements could be made of one single piece. Preferably however, they are integral in order to prevent any weak points which would reduce the efficiency of the CFD 1, or render it useless altogether.

Although the guiding device 5 can be made separate to the CFD 1, the guiding device 5 is preferably mounted onto the support structure 3 and cooperates with the fixed frame 11 so as to guide the cable operated door 9 along the fixed frame 11. Preferably, the guiding device 5 consists of a roller 31 mounted about an axle 33 of the support structure 3. The advantage of placing the guiding device 5 on the support structure 3 will become apparent hereinafter.

Preferably also, the fixed frame 11 consists of a side rail. The roller 31 engaged with the side rail travels along the inside of the side rail and is similar to a regular roller common to most garage doors.

Figure 8:
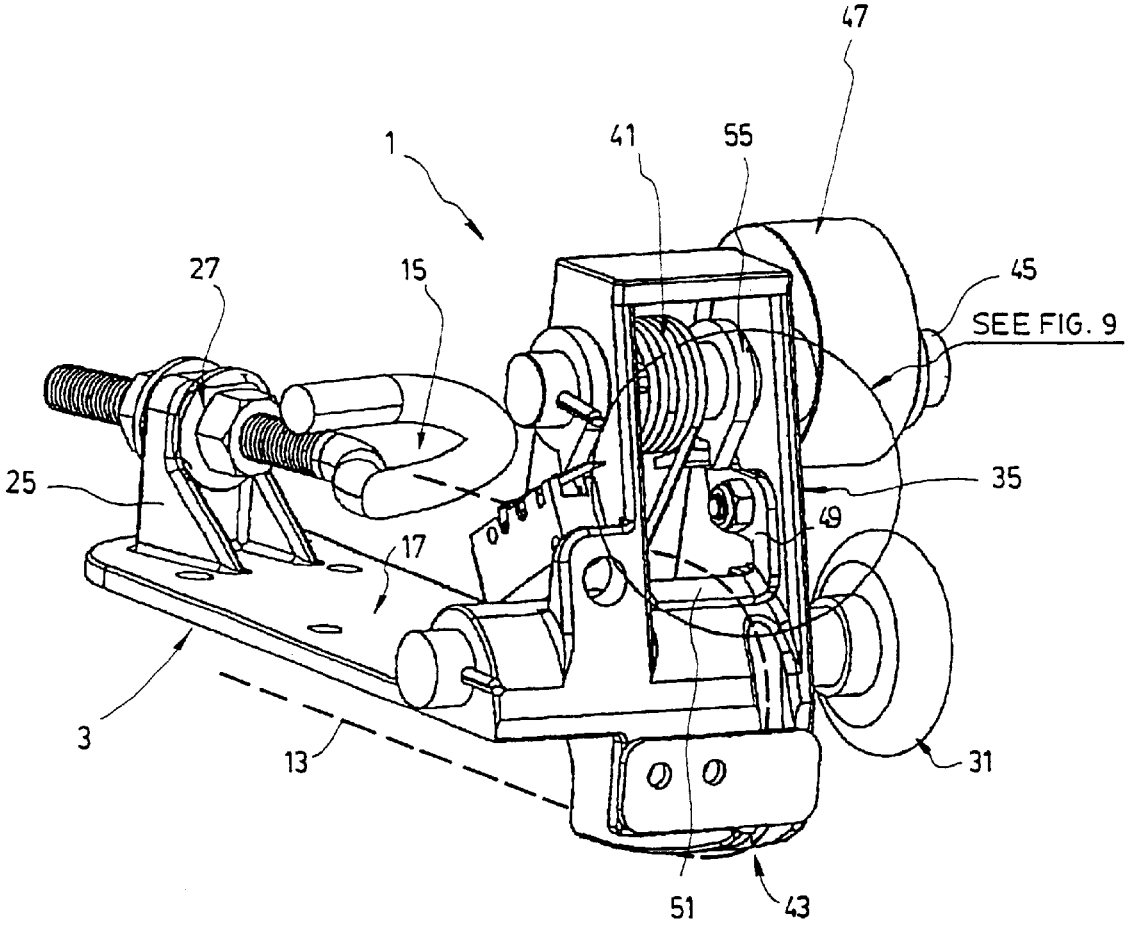
FIG. 8 is a bottom perspective view of the cable failure device shown in FIG. 1.

As better shown in FIGS. 1, 2, and 8, the brake assembly 7 is also mounted onto the support structure 3 and comprises a casing 35, a brake device 37, a tension-detecting device 39, and an actuating device 41. The casing 35 is mounted onto the support structure 3 and is preferably U-shaped. Preferably also, the support structure 3 comprises a guiding channel 43, also known as a "cable guide", for guiding the tensioned cable 13 so as to align the same with the tension-detecting device 39.

It is worth noting here that the support structure 3, the connection point 15, the guiding channel 43 and the casing 35 can be separate elements or can be made integral to each other. That is, one or several of these elements could be made of one single piece.

Preferably, the flange 25, the bracket 17, the guiding channel 43 and the U-shaped casing 35 are made of one single piece, as better shown in FIG. 1, for reasons which will become apparent hereinafter.

Figure 6:
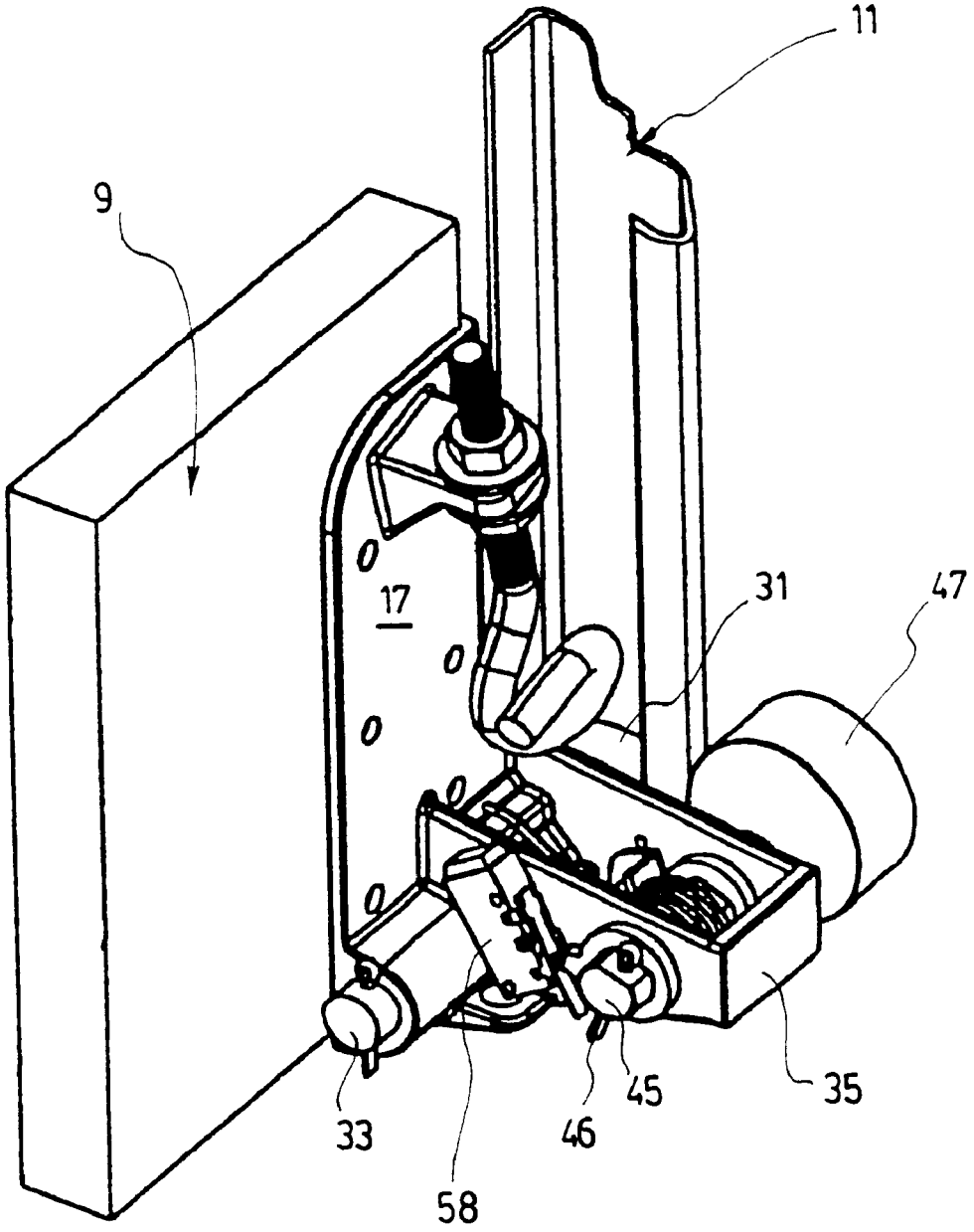
FIG. 6 is a perspective view of the cable failure device shown in FIG. 4, said cable failure device being shown mounted on a cable operated door and cooperating with a fixed frame.
Figure 7:
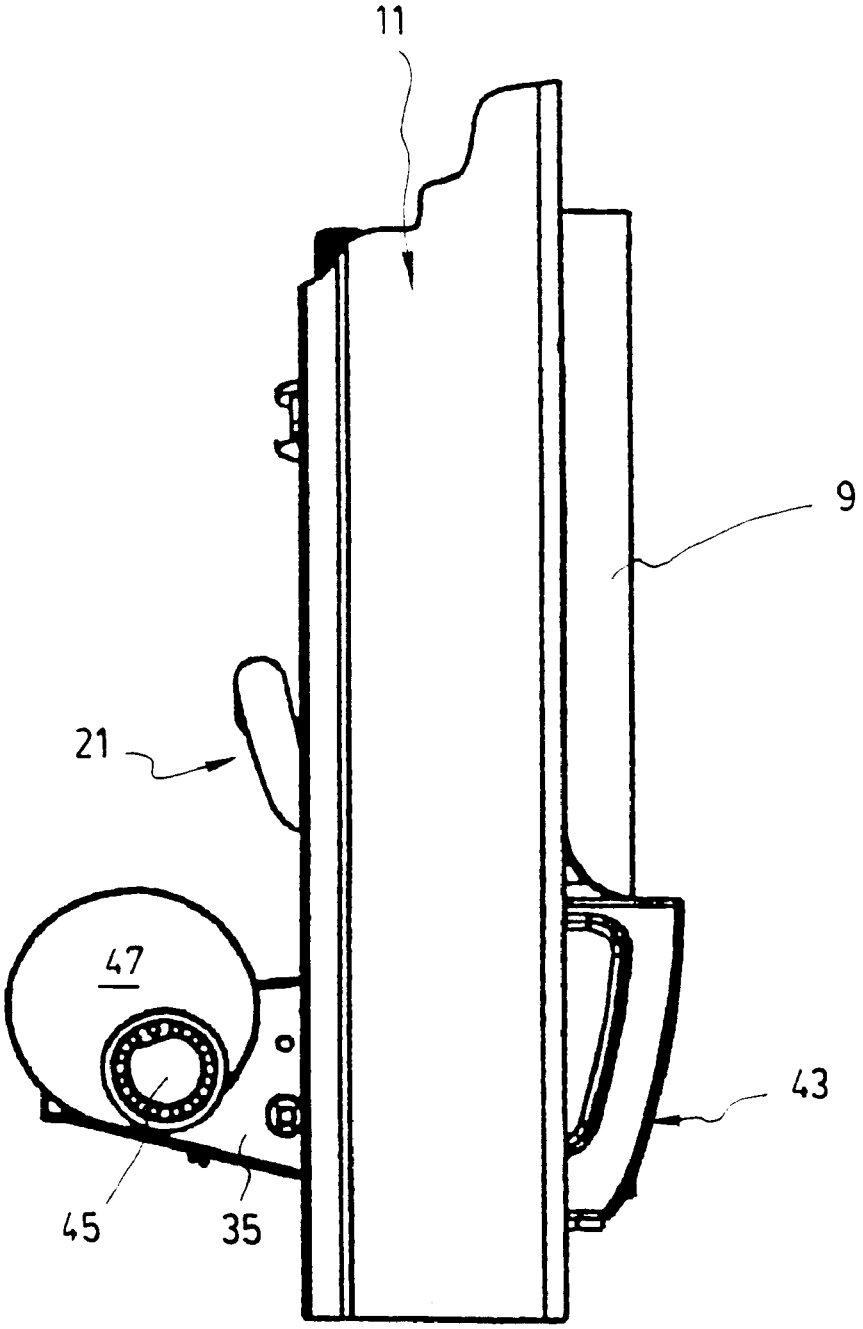
FIG. 7 is a side plan view of the cable failure device and fixed frame shown in FIG. 6.

The brake device 37 is operable between a rest position and an operable position, and is pivotally mounted to the support structure about an axle 45 of the casing 35. The brake device 37 is located adjacent an outside of the fixed frame 11 and is adapted to cooperate with the guiding device 5, so that the fixed frame 11 lies between the guiding device 5 and the brake device 37, as better shown in FIGS. 6, 7 and 10.

The tension-detecting device 39 cooperates with the tensioned cable 13 and is used for detecting a tension therein. The actuating device 41 is operatively connected to the tension-detecting device 39 and to the axle 45 of the brake device 37.

As better shown in FIGS. 1, 3, 4, 6, 7 and 10, the CFD 1 is characterized in that the brake device 37 is eccentrically mounted onto the axle 45 and is adapted to engage the fixed frame 11. When the brake device 37 is in the rest position, the guiding device 5 normally guides the cable operated door 9 along the fixed frame 11, as better shown in FIG. 7. When the brake device 37 is triggered into the operable position by a loss of tension in the tensioned cable 13 detected by the tension-detecting device 39, the loss of tension causes the actuating device 41 to actuate the axle 45 thereby actuating the brake device 37 so that the brake device 37 engages the fixed frame 11, thereby braking the movement of the cable operated door 9 with respect to the fixed frame 11, as better shown in FIG. 10. That is, when the brake device 37 is triggered into the operable position, the brake device 37 and the guiding device 5 are urged towards each other and the fixed frame 11 becomes firmly clamped between the brake device 37 and the guiding device 5, thereby preventing any downward movement of the cable operated door 9. In fact, due to the direction of pivoting, and since the cable operated door 9 has a tendency to move downwardly (towards the bottom of the page on FIG. 10), the brake device 37 has a tendency to "bite" into the fixed frame 11. As it will be apparent to a person skilled in the art, it is preferable for the brake device 37 and the guiding device 5 to be mounted on a single, integral piece. This obviates the risk of a connection member connecting two separate pieces together from breaking and reducing the usefulness of the CFD 1 or rendering it inoperable.

The brake device 37 preferably consists of a knurled brake pad 47 made of a material having a high coefficient of friction.

Figure 9:
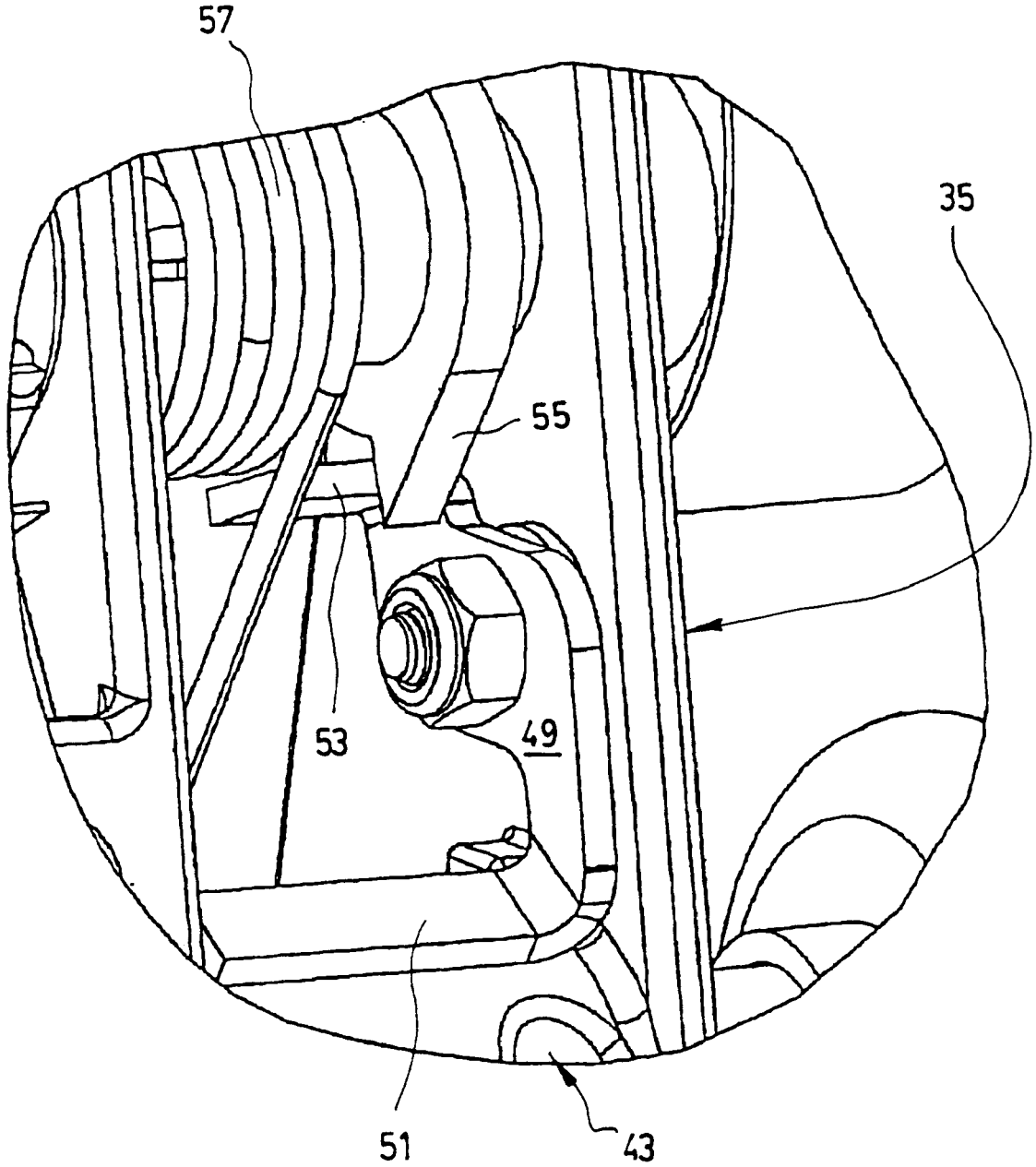
FIG. 9 is an enlarged view of a portion of the cable failure device shown in FIG. 8.

As better shown in FIG. 9, the tension-detecting device 39 consists of a lever 49, also known as a "trigger-arm", pivotally connected to the casing 35. The lever 49 has a first extremity 51 held in position by the tensioned cable 13 and a second extremity 53 resting against a trigger plate 55 rigidly mounted onto the axle 45.

Figure 5:
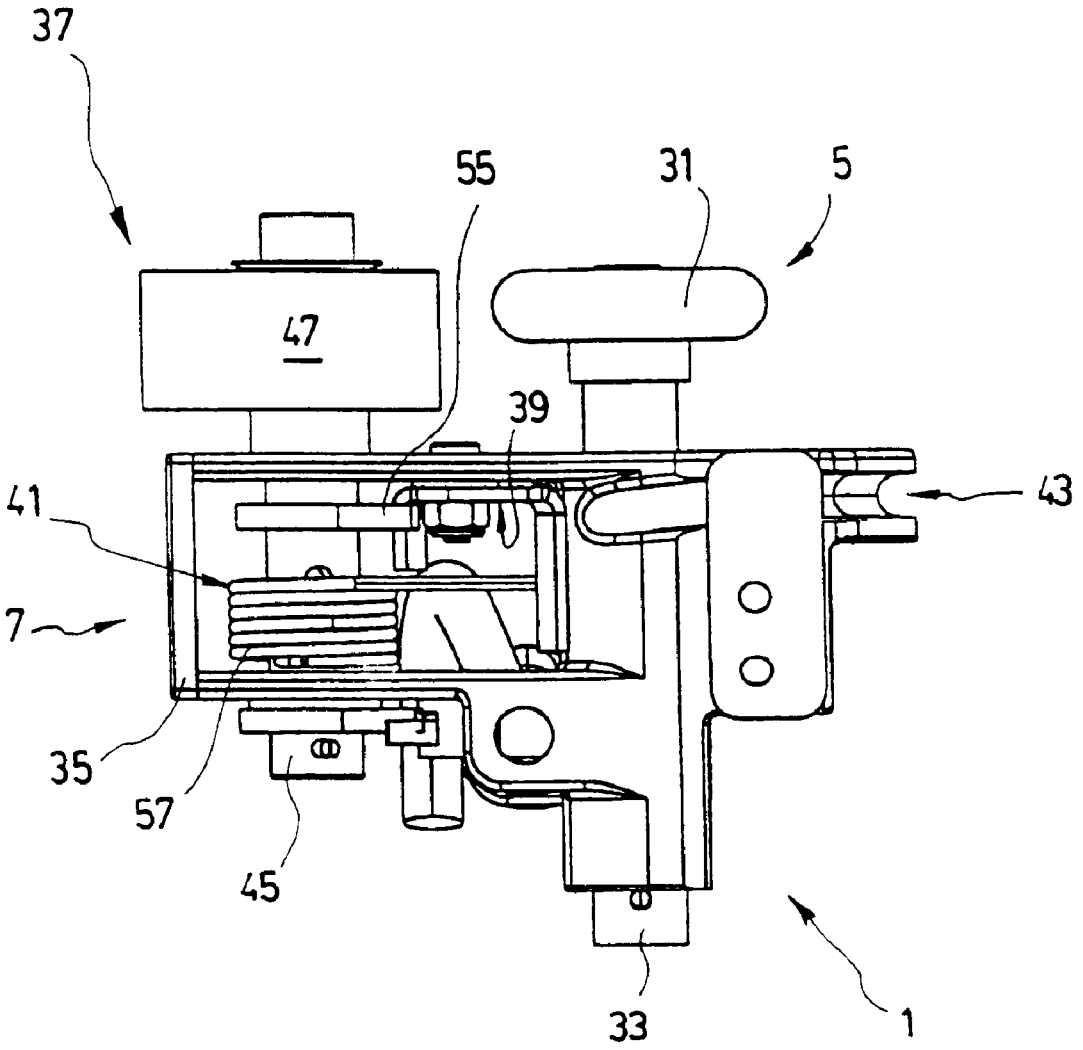
FIG. 5 is a bottom plan view of the cable failure device shown in FIG. 4.

As better shown in FIGS. 2, 5, and 8, the actuating device 41 preferably consists of an energy-storing spring 57 having a first end fixedly mounted onto the axle 45 and a second end securely mounted onto the support structure 3. When the brake device 37 is in the rest position, the trigger plate 55 maintains the energy-storing spring 57 in a compressed position thereby storing energy in the energy-storing spring 57. A loss of tension in the tensioned cable 13 releases the lever 49 which consequently releases the trigger plate 55 in turn allowing the axle 45 to rotate due to the energy released by the energy-storing spring 57. This in turn triggers the brake device 37 into the operable position so that the brake device 37 frictionally engages the outside of the fixed frame 11 (side rail), thereby braking the movement of the cable operated door 9 with respect to the fixed frame 11, as better shown in FIG. 10 and as aforementioned. The energy-storing spring 57 preferably consists of a torsion spring 57 as shown in FIGS. 5, 8 and 9. Although an energy-storing spring 57 has been contemplated for use as the actuating device 41, it should be understood, by a person skilled in the art, that other elements with adequate torque requirements could be used as an actuating device 57 to fulfill the objects of the present invention.

As shown in FIGS. 4 to 9, when the brake device 37 of the CFD 1 is in the rest position, the roller 31 guides the garage door along the fixed frame 11 (side rail). The tensioned cable 13 is in place with one of its free ends attached to the hook 21 and the other free end connected to the counterbalancing mechanism (not shown). The tensioned cable 13 passes through the casing 35 and over the first extremity 51 of the lever 49. The guiding channel 43, also known as "cable guide", allows the tensioned cable 13 to go under the device and then towards the overhead counterbalancing system (not shown). The guiding channel 43 also enables to align the tensioned cable 13 with the lever 49 so that the tensioned cable 13 properly rests against the first extremity 51 of the lever 49, the first extremity 51 being preferably slightly curved. The torsion spring 57 is pre-loaded to bias the trigger plate 55, rigidly mounted onto the axle 45, against the second extremity 53 of the lever 49, the second extremity 53 also being preferably slightly curved so that the lever 49 is maintained in position as long as there is a predetermined amount of tension in the tensioned cable 13 to prevent the axle 45, and thus the brake pad 47, from rotating.

The brake device 37 of the CFD 1 is triggered into the operable position if a failure occurs in the tensioned cable 13 or in any element holding the tensioned cable 13, that is, if the tension in the tensioned cable 13 is significantly reduced. If this loss of tension reaches a predetermined value, the lever 49 is no longer prevented from pivoting under the biasing force exerted by the torsion spring 57. The trigger plate 55 pushes on the lever 49 and the axle 45 pivots, bringing the brake pad 47 in contact with the adjacent outside surface of the side rail. The pivot axis of the eccentric brake pad 47 is at the bottom thereof and the rotation caused by the torsion spring 57 is away from the garage door, towards the bottom, and onto the side rail. The brake pad 47 subsequently reaches the adjacent outside surface of the side rail.

Figure 10:
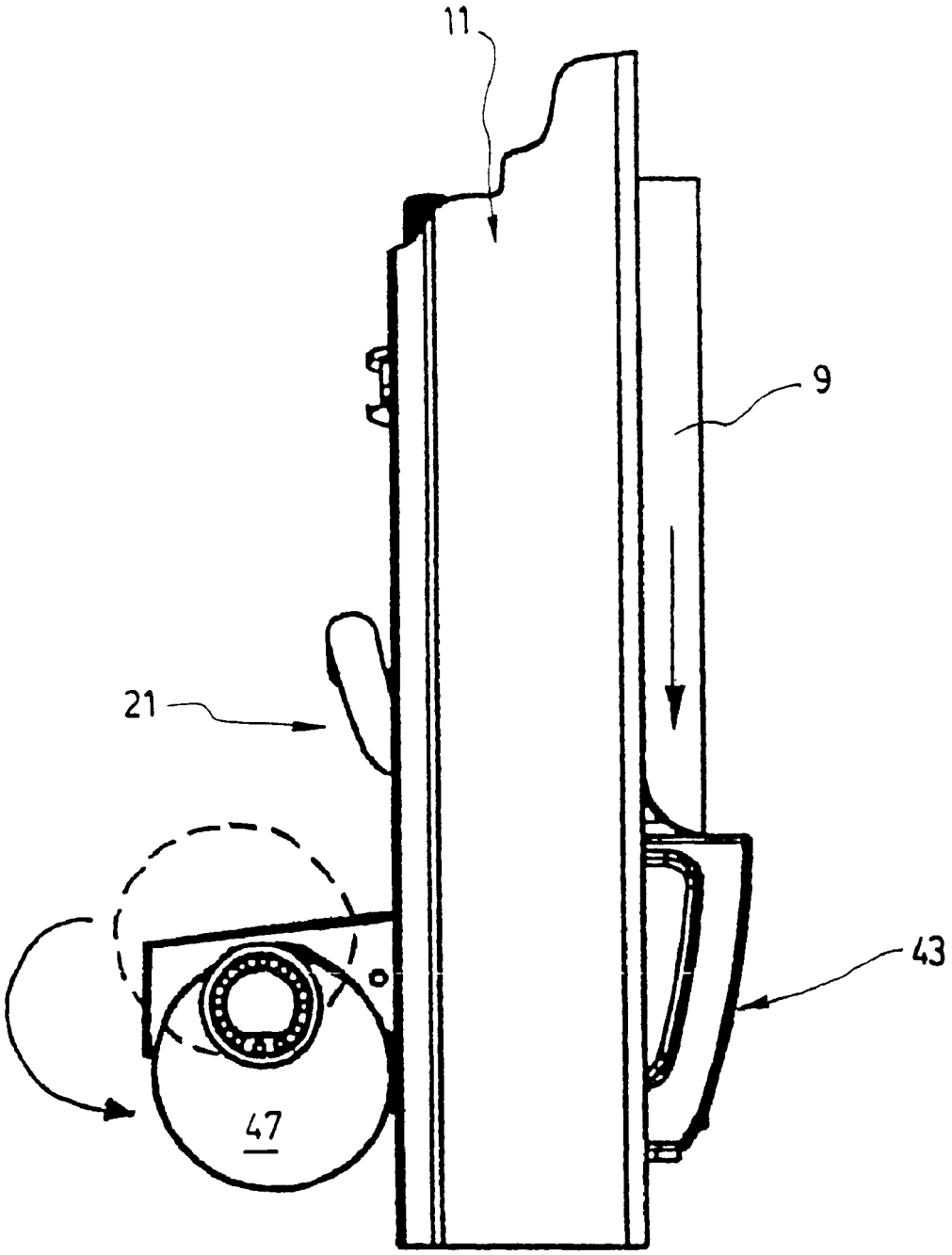
FIG. 10 is a side plan view of the cable failure device shown in FIG. 6, said cable failure device being shown in an operable position and engaged with the fixed frame.

As better shown in FIG. 10, as soon as the brake pad 47 touches the adjacent outside surface of the side rail, it starts to roll thereon while the garage door tends to move downward. However, the design of the CFD 1 is such that there is not enough clearance to allow a complete rotation of the brake pad 47. The brake pad 47 has preferably an elliptical form, and more specifically is circular, and is eccentrically mounted onto its axle 45. Hence, the brake pad 47 "bites" into the side rail. Because of the brake pad's eccentric effect and because the CFD 1 tends to move downward, along with the garage door, as shown in FIG. 10, the brake pad 47 "bites" more and more into the side rail. The brake pad 47 will then be jammed between the rail and the axle 45, preventing the garage door from moving because of the friction between the rail and the outer surface thereof. Effectively, the fixed frame 11, which preferably consists of the mentioned side rail, is firmly clamped between the brake pad 47 and the roller 31, thereby preventing any movement of the cable operated door 9 with respect to the fixed frame 11, whether up or down. All this occurs in a very short period of time. Hence, the fall of the door is stopped almost instantaneously. Preferably, the outer surface of the brake pad 47 is knurled and made of a material having a relatively high coefficient of friction so that a strong friction engagement will happen between the adjacent outside surface of the rail and the brake pad 47. Although the brake pad 47 is preferably a circular diamond-knurled brake pad 47, the brake pad 47 can have other different types of shapes and can be made of other different types of materials. As is apparent to a person skilled in the art, instead of a brake pad 47, one can use several other types of brake devices 37 eccentrically mounted onto the axle 45 of the support structure 3. Actually, eccentric mounting is not an essential requirement of this invention, what is essential is that the brake device 37 be operable between a rest position, where the garage door is permitted to function normally, and an operable position, where the brake device 37 cooperates with the guiding device 5 to pinch a portion of the side rail therebetween. Furthermore, it will be apparent that although the brake device 37 and the roller 31 do not necessarily need to be aligned with each other, they should be located close enough to permit adequate cooperation and effectively prevent relative movement of the CFD 1 with the rail. For example, in FIG. 4, the axes of rotations of the brake device 37 and the roller 31 are slightly offset.

In the case where the garage door is electrically operated, the CFD 1 is further provided with a limit switch 58, as better shown in FIG. 2. This limit switch 58 can send either an ON or an OFF signal to the motor (not shown) driving the door, in order to prevent any damage to the motor. The limit switch 58 is preferably connected to the motor via a wire (not shown), although the signal could be sent remotely. When the brake device 37 is in the rest position, the limit switch 58 sends an ON signal to the motor, allowing it to operate normally. However, when the brake device 37 is triggered into the operable position, axle 45 is pivoted, forcing pin 46 to actuate the limit switch 58 which sends an OFF signal to the motor, thereby shutting it down and preventing any damage. Should the tensioned cable 13 fail while the cable operated door 9 is being raised or lowered, without the limit switch 58, the motor would keep operating and probably eventually burn out.

Figure 11:
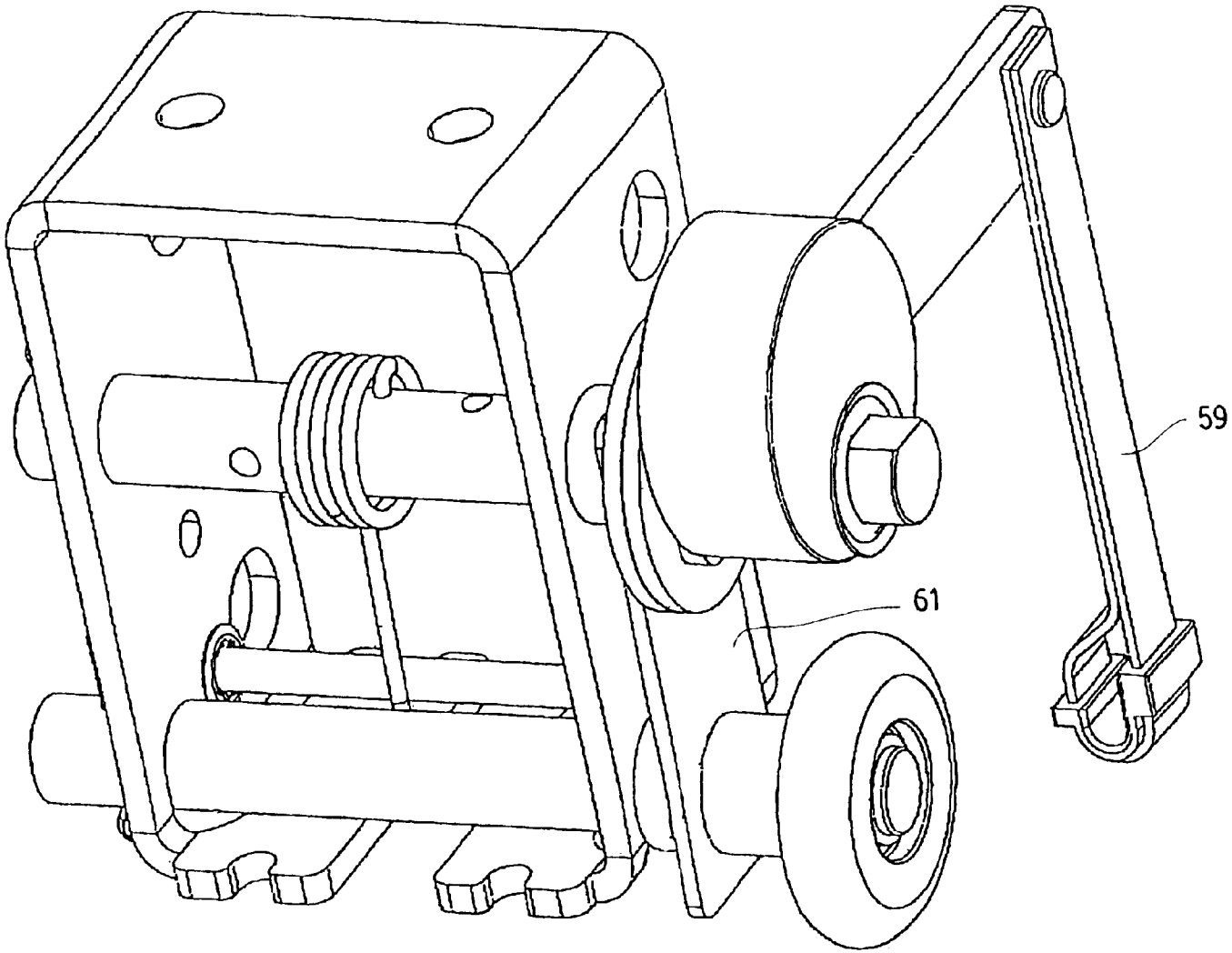
FIG. 11 (PRIOR ART)
FIG. 11 is a perspective view of a cable failure device according to the prior art.

The present invention is an improvement and presents several advantages over cable failure brakes known on the prior art, such as the one illustrated in FIG. 11. For instance, there is no lever projecting from the device of the present invention, compared with the device in FIG. 11 that uses a projecting lever 59. The present invention uses a smaller lever 49 that is located inside the casing 35. Furthermore, the prior art device shown in FIG. 11 needs a reinforcement plate 61 which is not required in the device according to the present invention. The present invention uses its own casing 35 as a reinforcement plate to absorb the energy of the free falling door. By placing the casing 35 on the side of the bracket 17, one of the legs of the U-shaped casing 35 is used as the reinforcement plate. With this evolution, there is no need for a supplementary plate. The present invention may be used in the garage door industry, with new garage doors or existing garage doors. In the case of a cable failure, the present invention immediately stops the fall of the garage door and maintains it safely immobilized where it is until the necessary inspections and repairs are made. As it is evident from reading the above description, the present invention is a cable failure device used for immobilizing a cable operated door 9, such as garage doors and the like, in the event of a failure of one of the cables 13 operating such cable operated door 9 or in the event of a failure of one of the elements holding the cables 13. In such cases, the present invention impedes free falling of the cable operated door 9 and prevents damages and injuries. The present invention is a more compact, more reliable, easier to use, easier to maintain, safer and more cost effective safety device than those available in the prior art. Furthermore, the present invention may be used with other kinds of doors, such as slidable truck doors, or with any other items suspended by a cable, as apparent to a person skilled in the art.

Of course, numerous modifications could be made to the above-described embodiments without departing the scope of the invention as defined in the appended claims.

What is claimed is:

1. A cable failure device for a cable operated door whose movement is guided along a fixed frame through guiding means, the fixed frame having an inside and an outside, said guiding means travelling along the inside of said fixed frame, said cable failure device cooperating with a tensioned cable operating the cable operated door, said cable failure device comprising:

a support structure mounted onto said cable operated door, said support structure comprising a connection point onto which the tensioned cable is connected; and a braking assembly mounted onto the support structure, said braking assembly comprising:

a casino mounted onto the support structure, brake means operable between a rest position and an operable position and movably mounted to the support structure, said brake means being located adjacent the outside of said fixed frame, and adapted to cooperate with one of said guiding means, so that a portion of said fixed frame lies between said one of said guiding means and said brake means, tension-detecting means cooperating with the tensioned cable for detecting a tension in said tensioned cable, and actuating means operatively connected to the tension-detecting means and to the brake means, wherein when the brake means is in the rest position, the guiding means guide the cable operated door along the fixed frame, and when the brake means is triggered into the operable position by a loss of tension in the tensioned cable detected by the tension-detecting means, said loss of tension causes the actuating means to actuate the brake means so that the brake means engages the outside of the fixed frame, thereby urging said brake means and said one of said guide means towards each other, thereby braking the movement of the cable operated door with respect to the fixed frame;

the actuating means are operatively connected to an axle of the casing, and the brake means is pivotally mounted to the support structure about said axle and eccentrically mounted thereon, the brake means being adapted to engage the fixed frame, so that when the brake means is in the rest position, the guiding means guide the cable operated door along the fixed frame, and when the brake means is triggered into the operable position by a loss of tension in the tensioned cable detected by the tension-detecting means, said loss of tension causes the actuating means to actuate the axle thereby actuating the brake means so that the brake means engages the fixed frame, thereby urging said brake means and said one of said guide means towards each other, thereby braking the movement of the cable operated door with respect to the fixed frame; and the tension-detecting means comprises a lever pivotally connected to the casing, said lever having a first extremity held in position by the tensioned cable and a second extremity resting against a trigger plate rigidly mounted onto the axle, and the actuating means comprises an energy-storing spring having a first end fixedly mounted onto said axle and a second end securely mounted onto the support structure, so that when the brake means is in the rest position the trigger plate maintains the energy-storing spring in a compressed position thereby storing energy in said energy-storing spring, and wherein said loss of tension in the tensioned cable releases the lever which consequently releases the trigger plate in turn allowing the axle to rotate due to the energy released by the energy-storing spring, thereby triggering the brake means into the operable position so that the brake means frictionally engages the outside of the fixed frame, thereby braking the movement of the cable operated door with respect to the fixed frame.

2. A cable failure device according to claim 1, wherein said one of said guiding means is mounted onto the support structure.

3. A cable failure device according to claim 1, wherein the support structure comprises a guiding channel for guiding the tensioned cable so as to align said tensioned cable with the lever and facilitate a cooperation therewith.

4. A cable failure device according to claim 1, wherein the connection point comprises a hook having a first part removably mounted onto a flange of the support structure and a curved second part onto which is attached a free end of the tensioned cable.

5. A cable failure device according to claim 2, wherein the guiding means comprises a roller mounted about an axle of the support structure and wherein said fixed frame comprises a side rail, said roller being engaged in the inside of the side rail.

6. A cable failure device according to claim 3, wherein the support structure is provided with holes in which fasteners can be inserted for rigidly mounting said support structure onto the cable operated door.

7. A cable failure device according to claim 1, wherein the energy-storing spring is a torsion spring.

8. A cable failure device according to claim 1, wherein the casing is a U-shaped casing having two legs, one of said legs acting as a reinforcement plate.

9. A cable failure device according to claim 6, wherein said cable operated door is a garage door.

10. A cable failure device according to claim 1, wherein the brake means comprises a circular diamond-knurled brake pad.

* * * * *